United States Patent [19]

Goodwin, Jr. et al.

[11] 3,932,719

[45] Jan. 13, 1976

[54] CIRCUIT BREAKER HAVING A SINGLE PULL-ROD OPERATING SYSTEM WITH A SELECTIVE TRIP-FREE CONTROL

[75] Inventors: Edwin C. Goodwin, Jr., Canton; George K. Benham, Somerville, both of Mass.

[73] Assignee: Allis-Chalmers Corporation, Milwaukee, Wis.

[22] Filed: Dec. 26, 1973

[21] Appl. No.: 428,257

[52] U.S. Cl. ..... 200/148

[51] Int. Cl.[2] ..... H01H 33/82

[58] Field of Search.... 200/144, 145, 148 B, 148 D, 200/148 F, 148 R, 153 H, 148 J, 148

[56] References Cited

UNITED STATES PATENTS

| | | | |
|---|---|---|---|
| 3,033,962 | 5/1962 | Friedrich et al. | 200/145 |
| 3,215,797 | 11/1965 | Kesselring et al. | 200/148 J |
| 3,502,834 | 3/1970 | Field et al. | 200/144 B |
| 3,526,735 | 9/1970 | Date | 200/144 B |
| 3,601,565 | 8/1971 | Few | 200/144 B |

*Primary Examiner*—Robert K. Schaefer
*Assistant Examiner*—John W. Redman
*Attorney, Agent, or Firm*—Robert C. Jones

[57] ABSTRACT

A single pull-rod mechanism operatively arranged externally of gas insulated sealed enclosures for actuating the several contacts and associated blast valves of one or more circuit breakers. The mechanism is external of the enclosure to facilitate adjustment and servicing without the necessity of breaching the integrity of the gas sealed enclosures. Also provided is a selective mechanism for insuring that the blast valves are in closed positions and recoupled to the actuating mechanisms prior to the opening movement of the contacts.

20 Claims, 8 Drawing Figures

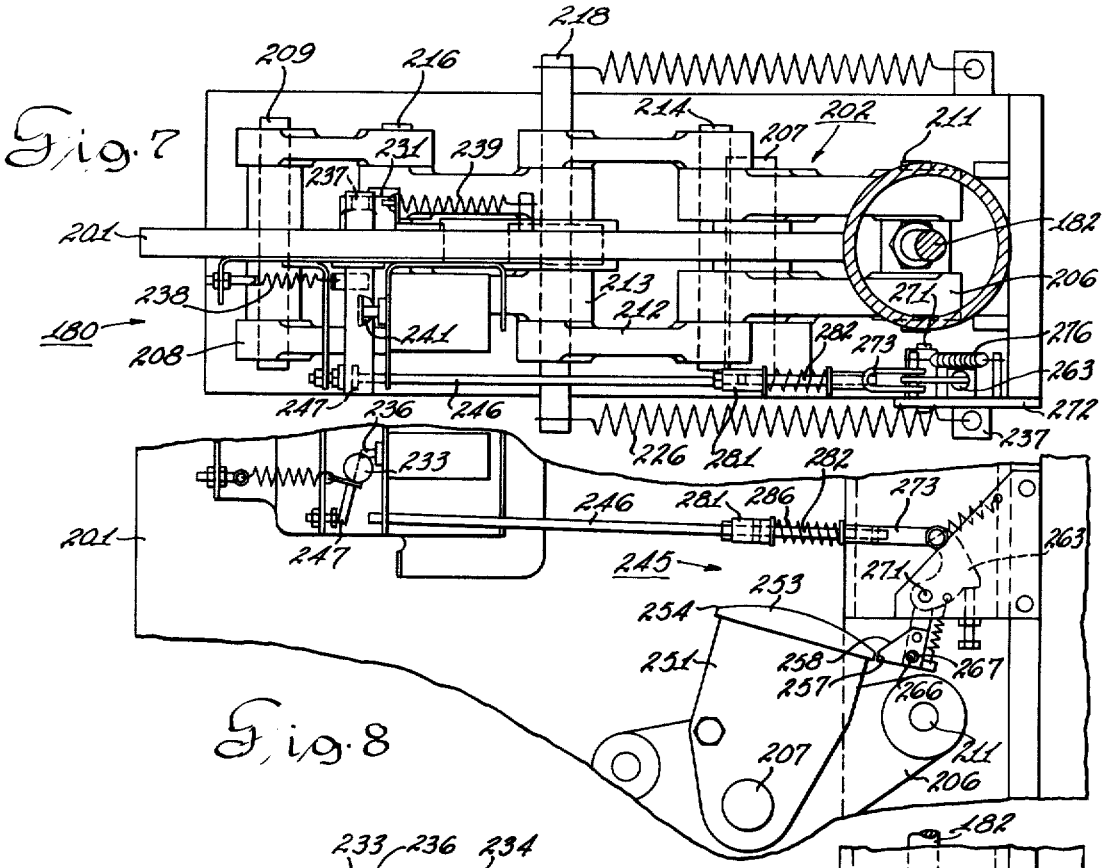
Fig. 7
Fig. 8
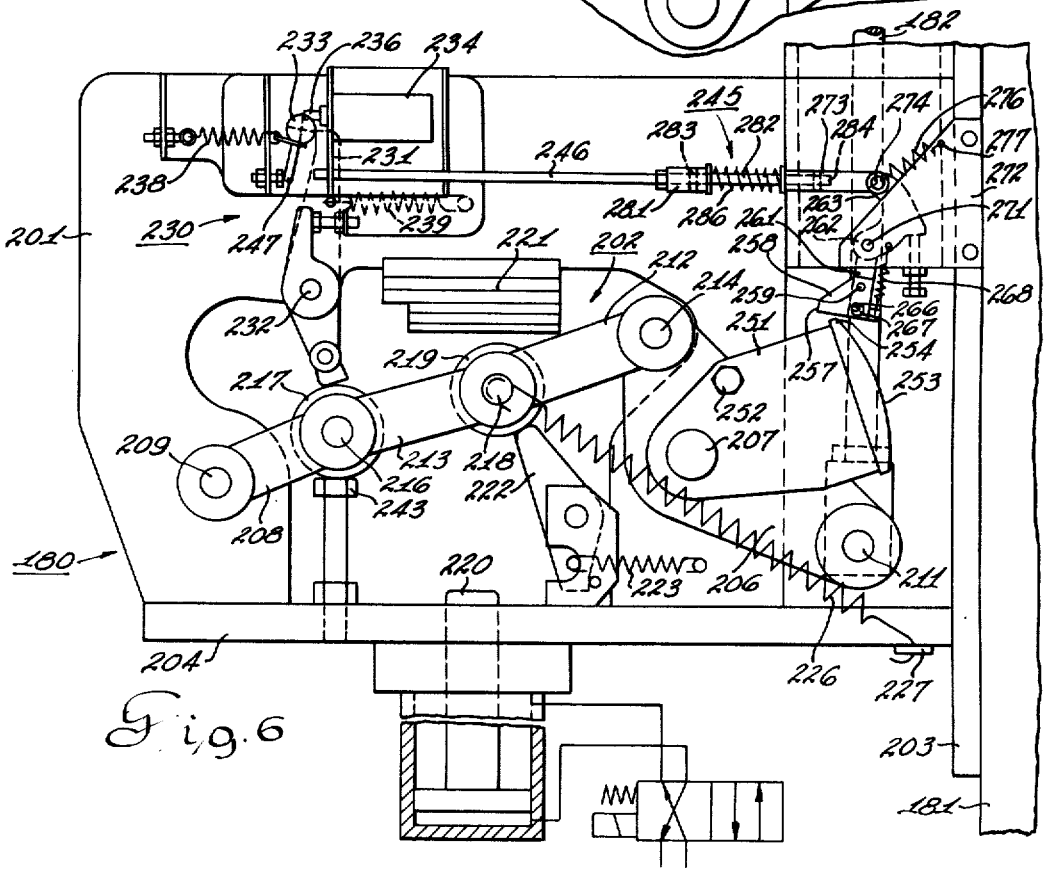
Fig. 6

CIRCUIT BREAKER HAVING A SINGLE PULL-ROD OPERATING SYSTEM WITH A SELECTIVE TRIP-FREE CONTROL

FIELD OF THE INVENTION

This invention relates generally to circuit breakers having mechanisms for operating main contacts and associated blast valves.

DESCRIPTION OF THE PRIOR ART

Circuit breaker arrangements of the gas-blast type having individual gas insulated tanks or chambers for each phase of an installation are usually provided with an individual operating mechanism for each phase or the operating mechanisms are restricted to side operations only. Operating mechanisms per phase installation are expensive and are extremely difficult to effect operating synchronization of all three phases. Operating mechanisms which are restricted to side operation severely restrict the installation arrangement of the circuit breakers and are not well adapted for circuit breakers which are to be utilized within an enclosure. Also, in circuit breaker installation of the type herein described, a means must be provided to assure blast valve actuation when the breaker is tripped with some means being incorporated to insure that the breaker will not trip until the blast valve mechanism has been conditioned for operation. In known prior art arrangements, no provision has been provided to insure the recoupling of the gas-blast valve operating means prior to the closing of the main contact so that at any time that the contacts of the circuit breaker are moved to an open position, either in a predetermined operation or under a fault condition, the blast valve will be conditioned to provide a blast of gas during parting of the contacts.

SUMMARY OF THE INVENTION

In accordance with the present invention, there is provided a gas insulated circuit breaker arrangement having one gas insulated circuit breaker per phase. Each breaker arrangement is provided with two serially connected disengageable contacts, each of which are supplied with a blast of gas by associated valve mechanisms that are operated in timed relationship to the opening of the contacts. The installation includes a pull-rod system which is operably arranged to actuate all breakers in timed synchronization. The pull-rod system has a maximum of associated components external to insulating gas chambers and is adaptable for either front or side actuation of all three phases by a single operating mechanism. The interconnection between phases provides built-in synchronization with the motion transfer crank permitting easy adaptation for front or side actuation when required.

There is also provided an operating mechanism for the gas circuit breakers which will insure blast valve actuation coincident with the main contact breaking operation which is desirable with the particular type of circuit breaker arrangement herein described. The mechanism provided controls the operation of all three circuit breakers associated with a three-phase installation. Blast valve actuation of all three phases is assured by selecting only that portion of a breaker operating cycle, mainly the larger part of the closing stroke, in which the breaker cannot be tripped until the blast valve mechanism has recoupled.

OBJECTS OF THE INVENTION

It is an object of the present invention to provide a gas breaker pull-rod system permitting the operating mechanism to be located at the breaker tank end for simplified multiphase application and is adaptable to side actuated arrangements.

Another object of the present invention is to provide a pull-rod system which permits the control cabinet and the operating mechanism to be loacted at the tank end of the breaker installation, which arrangement facilitates and simplifies multiphase installations.

Still another object of the present invention is to provide a pull-rod system which is readily attachable to standard pull-rod system applications when gas insulated breakers are utilized in outdoor systems.

Yet another object of the present invention is to provide a pull-rod system with transit crank which provides a simplification of installation to reduce costs and provide positive operation of the contacts.

A further object of the present invention is to provide an operating pull-rod system which eliminates the necessity of a torsion bar arrangement thereby eliminating the necessity of providing large diameter shafts and self-aligning bearings for supports thereof.

A further object of the present invention is to provide a pull-rod operating system having the various components external to the insulating gas chamber of each phase of the breaker arrangement and which are readily accessible for adjustments, inspections and replacement, if necessary.

Still another object of the present invention is to provide a pull-rod system for operating the contacts and blast valve mechanism in synchronization in which the entire system is totally enclosed so that when used in outdoor installations the weather and other contaminants are excluded from the operating mechanism.

Another object of the present invention is to provide an operating mechanism for a gas circuit breaker which will insure blast valve actuation coincident with main contact operation at the same time providing a trip-free operation feature which is required in this type of installation.

A further object of the invention is to provide means for selecting a portion of the breaker operating cycle in which the breaker cannot be tripped until the blast valve has been conditioned to its closed position and is operable to provide a blast of gas to the arcing area.

Other objects and advantages of the present invention will become more readily apparent hereafter when taken in consideration with the following description and drawings.

DESCRIPTION OF THE DRAWINGS

FIG. 6 is an enlarged detailed view of the operator and the selective trip-free arrangement;

FIG. 7 is an enlarged detailed view in plan of the mechanism shown in FIG. 6; and, FIG. 8 is an enlarged detailed view of the selective mechanism associated with the trip-free mechanism showing its position when released.

DESCRIPTION OF THE INVENTION

Figure 1:
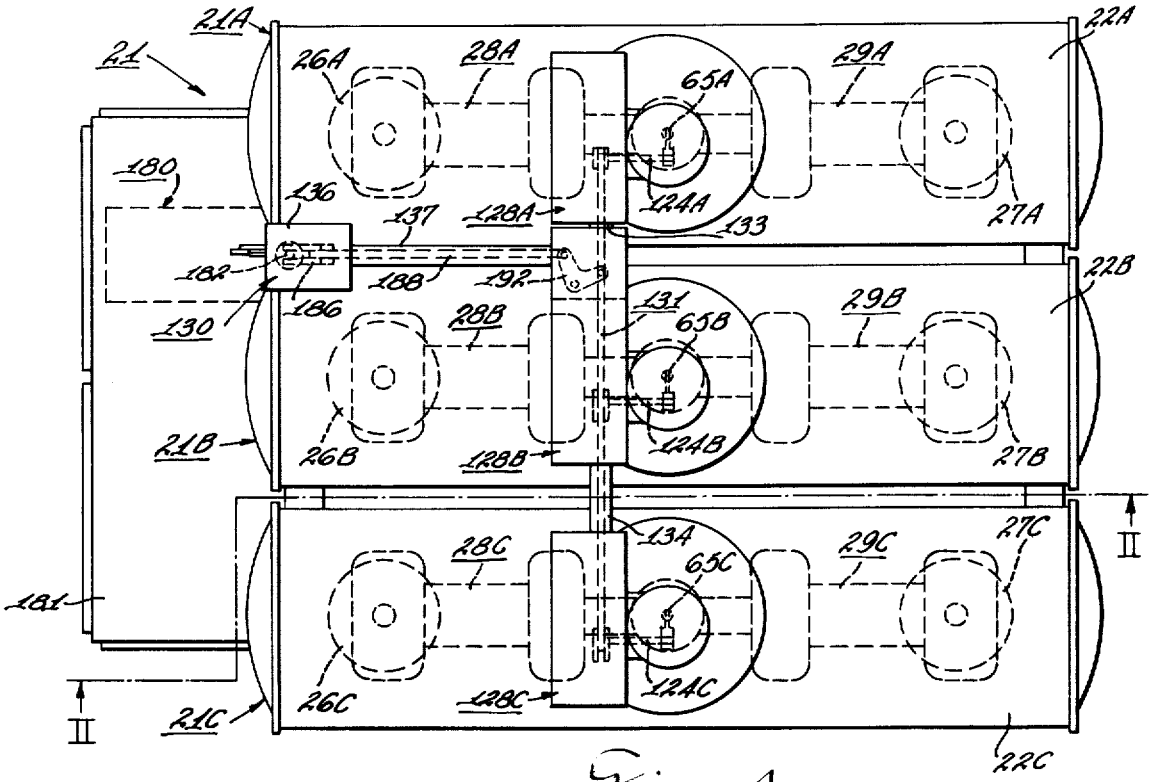
FIG. 1 is a plan view of a three-phase gas insulated circuit breaker arrangement incorporating the present invention.

In FIG. 1 there is shown a circuit breaker substation installation 21 comprising three circuit breaker units 21A, 21B and 21C, one for each phase of the three-phase system. Each of the phase unit circuit breakers are identical and, thus, like parts, will be identified by the same reference numeral, a particular unit to which the part relates being identified by an additional letter.

Figure 3:
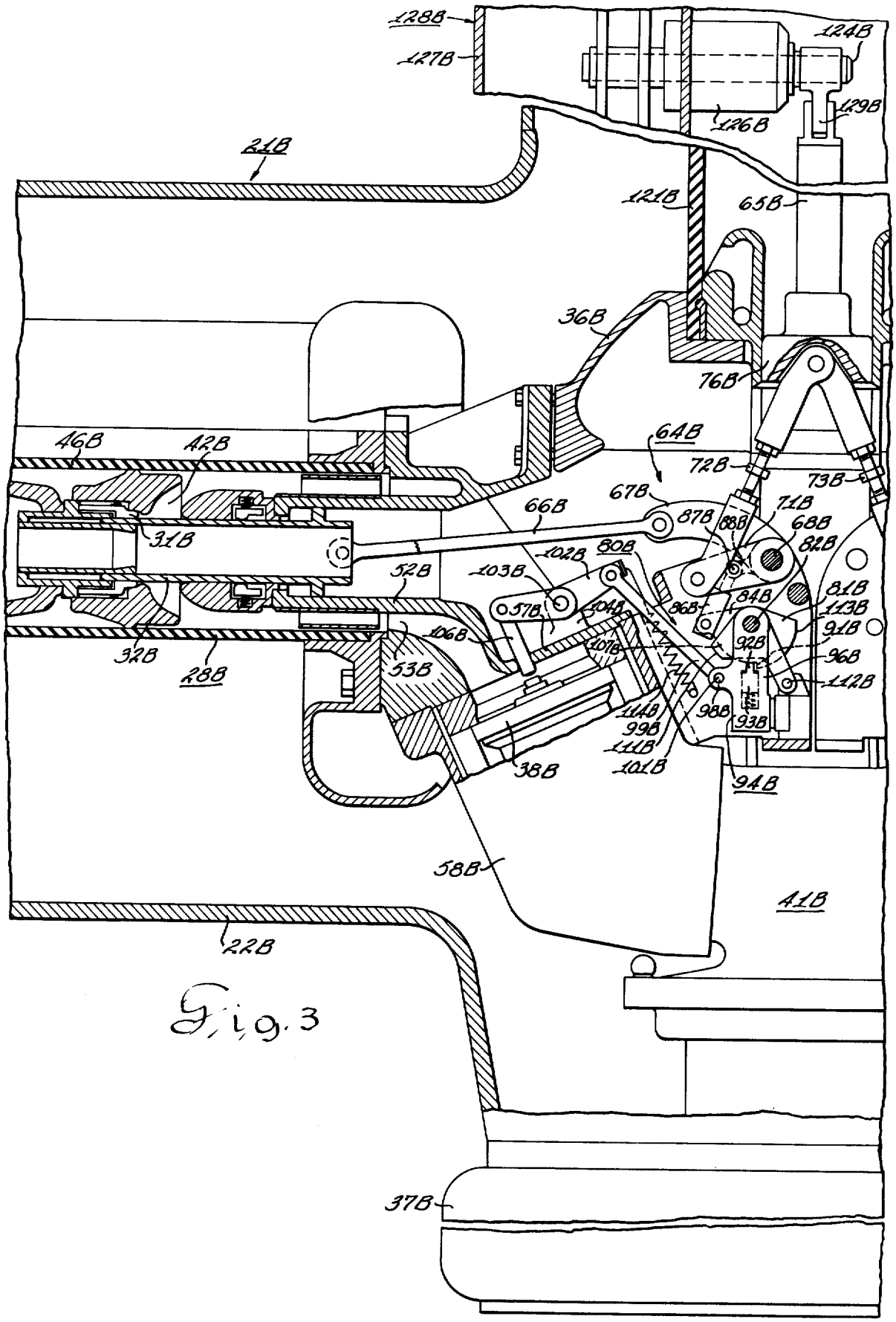
FIG. 3 is an enlarged fragmentary view partly in vertical section and partly in elevation through a portion of an interrupter tank showing one main contact and the associated blast valve mechanism with the operating mechanism for the elements.

The circuit breakers 21A, 21B and 21C include respective gas sealed tanks 22A, 22B and 22C. Line connections to and through each phase unit circuit breaker is effected through enclosed bus housings 23 and 24. The bus housings 23 and 24 are connected to depending entrance housings 26 and 27 in sealed flange-to-flange relationship. Within each phase unit circuit breaker, there is operatively supported a pair of serially connected interrupters 28 and 29, each of which includes a stationary main contact 31, FIG. 3, and an axially movable main contact 32. The contacts 31B and 32B are associated with the left-hand interrupter unit 28B of the phase unit 21B and is shown in detail in FIG. 3. Since each phase unit of the circuit breaker is identical and the unit constructed symmetrically on either side of a dividing vertical axis, only the left-hand side of the phase unit 21B is depicted in FIG. 3. As there shown, the interrupter 28B is supported in operative position by a central supporting casting 36B which also serves to electrically interconnect the interrupters 28B and 29B.

The circuit breakers are of the gas-blast type and arc extinction between the separable contacts is effected by supplying a blast of insulating gas at a relatively high pressure through the arc drawn between the separable contacts, such as the contacts 31B and 32B, as they are parted. For this purpose, a supply of insulating gas at a relatively high pressure is stored in a tank 37B which is supported in depending relationship from the bottom of the insulating tank 22B. Valve means, such as the valve 38B, are operable when actuated to allow a blast of gas to emit from the storage tank 37B. The blast of gas from the tank 37B through the valve 38B is directed by means of a manifold 41B to the arc area 42B between the separable contacts.

As shown, the contacts in the interrupter unit 28B comprise an insulating contact housing 46B which is supported in cantilever fashion from the central casting 36B. The axially movable main contact 32B is supported for axial movement in a tubular support nozzle 52B which forms the gas passage 53B through which the gas from the tank 37B passes.

An elbow 58B is secured to a bottom mounting surface formed with the casting 52B. The opposite end of the elbow 58B mates in sealed relationship on an outlet of the T-shaped manifold header 41B which operates to distribute the gas to the units 28B and 29B.

Within the elbow 58B, the blast valve 38B is operatively supported and is biased to its closed position that it occupies, as depicted in FIG. 3, by means of a spring (not shown). The blast valve 38B is adapted to be moved downwardly to allow a blast of high pressure gas to flow from the elbow into the passage 53B surrounding the nozzle 52B and directed to the area 42B wherein an arc is drawn upon the separation of the contacts.

Axial movement of the contact 32B to open and closed positions relative to the stationary contact 31B is effected by linkage operator 64B. A similar arrangement for the contact of the interrupter 29B is also provided. The linkage operator 64B associated with each of the interrupters is actuated simultaneously by means of the movable operating rod 65B. The axial movement of the movable contact 32B is accomplished by means of a connecting rod 66B that is pivotally connected to the end of the movable contact 32B. The opposite end of the connecting rod 66B is pivotally connected to an arcuate shaped lever arm 67B that is mounted for pivotal movement about a pin 68B. The arcuate arm 67B has integrally formed therewith a pair of spaced arms 71B, the free ends of which receive between them the end of an adjustable tie link 72B as shown. The tie link 72B is pivotally attached to a guide piston 76B carried on the end of the insulated actuating rod 65B. In a similar manner, the tie link 73B associated with the components of the interrupter 29B is also pivotally connected to the piston 76B. Thus, upward movement of the piston 76B, as viewed in FIG. 3, will effect the upward movement of the tie links 72B and 73B thereby pivoting the arcuate arm 67B about the pin 68B in a clockwise direction. The pivotal movement of the arm 67B will effect withdrawal or opening movement of the contact 32B and also of the contact associated with the unit 29B through its associated linkage.

As previously mentioned, upward movement of the rod 65B also effects the synchronized operation of the blast valve 38B and also of the blast valve associated with the unit 29B in timed relationship to the opening movement of the contacts. To effect the timed opening movement of the blast valve 38B, there is provided operating linking means 80B comprising a cam member 81B which is pivotally mounted on a pin 82B. The cam member 81B is provided with an arm portion 84B that pivotally receives the end of an adjustable tie link 86B. The opposite end of the tie link 86B is pivotally secured on a pin 87B that extends through relatively short arm 88B provided on the link 71B. Thus, as the lever arm 67B is moved in a clockwise direction, the arms 88B will move with it in the same direction, thereby effecting the pivotal movement of the cam member 81B about the pin 82b in a clockwise direction. As the cam member 81B pivots in a clockwise direction, a vertical cam face 91B engages a tongue portion 92B of a retractable latch 93B which is supported for axial movement in a latch body 94B. The latch body 94B is provided with two upwardly extending spaced arms 96B, one of which is shown, which are pivotally mounted on the pin 82B on which the cam 81B is also mounted. Thus, as the cam member 81B is pivotally moved in a clockwise direction, the vertical cam face 91B will engage the side surface of the latch tongue 92B thereby forcing the latch body 94B to pivot about the pin 82B in a clockwise direction. The pivotal movement of the latch body 94B in a clockwise direction, as viewed in FIG. 3, will effect the opening of the blast valve 38B. To this end, the latch body 94B is provided with a bifurcated arm portion 98B which receives the lower end of an adjustable rod 99B therebetween. A pin 101B operates to pivotally connect the rod 99B between the bifurcated arm portion 98B to allow the rod to have freedom of movement in a vertical plane. The upper end of the rod 99B is pivotally connected to the rightwardly extending end of a lever 102B which is pivotally secured by a pin 103B to a boss 104B that is integrally formed with the mounting base 57B to which the elbow 58B is secured. The leftwardly extending end of the lever 102B, as viewed in FIG. 3, is pivotally connected to a valve actuating rod 106B which extends through a suitable opening provided in the base 57B and that is adapted to engage the blast valve 38B. The clockwise pivotal movement of the latch body 94B imparts an upward movement to the rod 99B thereby effecting the pivotal movement of the lever 102B. This movement of the lever will cause the pin 106B to move downwardly to engage and open the blast valve 38B allowing gas at a relatively high pressure to flow to the arcing gap 42B.

As previously mentioned, the blast valve 38B must be allowed to close as soon as possible after a blast of gas has been delivered to the arcing area 42B. To effect a release of the blast valve 38B while still maintaining the rightward withdrawal movement of the contact 32B a disengaging or decoupling means is provided which is operative to release the latch body 94B from the cam member 81B. To this end, as the latch body 94B moves in a clockwise direction, as viewed in FIG. 3, the tongue portion 92B rests against surface 107B until such time as the tongue portion 92B engages a stationary cam 111B maintained in stationary position by means of an arm and pin connection 112B affixed to a supporting abutment. Thus, as the cam member 81B rotates about the pin 82B in a clockwise direction, the latch body 94B moving with the cam member 81B will forceably engage the tongue 92B against the cam member 111B thereby forcing the latch tongue 92B inwardly. As the rotation of latch body 94B continues in a clockwise direction, the latch tongue 92B will be moved further into the latch body 94B until such time as a trailing cam surface 113B of the cam 81B moves over the top surface of the tongue portion 92B. With this condition obtained, a tension spring 114B pivots the arm 102B in a clockwise direction thereby lifting the pin 106B free of the blast valve 38B to release the blast valve so that the spring (not shown) operates to permit the return of the valve 38B to its closed position, as depicted in FIG. 3. This condition is obtained because the tongue 92B now rides on the cam surface 113B, and under the urgency of the spring 114B the latch body 94B will be returned to its original position, as depicted in FIG. 3, while the tongue 92B maintains engagement with cam surface 113B and is maintained retracted. As the cam member 81B continues to rotate in the clockwise direction to effect the complete rightward opening movement of the movable contact 32B, the blast valve 38B will reset to closed position for subsequent operation.

When the rod 65B is moved downwardly in a contact closing operation, the arcuate arm 67B is caused to pivot in a counterclockwise direction about the pin 68B, thereby moving the cam member 81B in a counterclockwise direction. This movement effects axial leftward movement of the rod 66B to thereby move the contact 32B to closed position. As the cam member 81B pivots in a counterclockwise direction in a contact closing operation, the surface 113B of the cam member rides over the tongue 92B of the latch 94B which has previously been returned to its vertical position that it occupies as depicted in FIG. 3. Thus, when the contact 32B has been moved to its fully closed position, the cam member 81B will have been rotated to the position it occupies, as depicted in FIG. 3, whereby the cam surface 113B will have been moved off the tongue 92B so that the latch 93B is returned to its coupled position with the cam member 81B. Thus, synchronous movement is effected between the movable contact 32B and the blast valve 38B and thereafter the release of the blast valve to reset position is accomplished.

Figure 2:
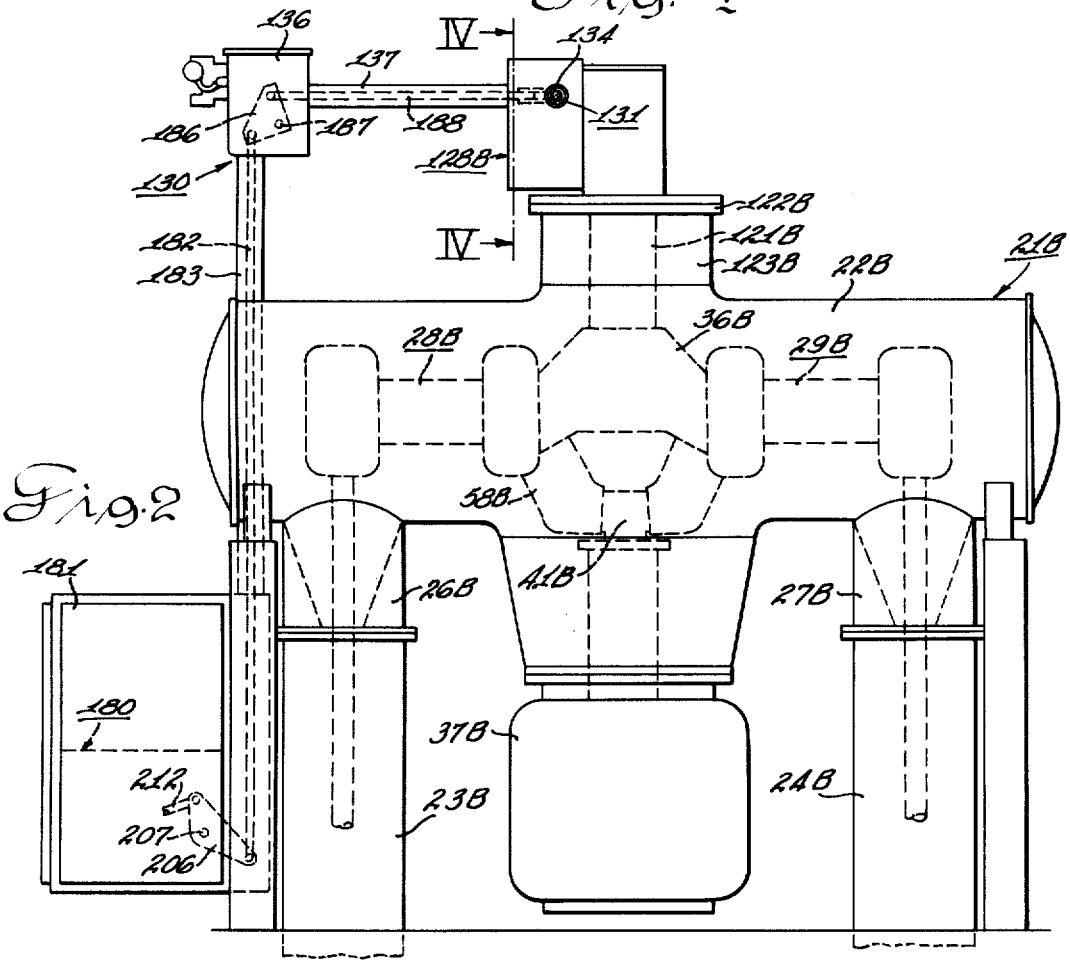
FIG. 2 is a view in side elevation taken in the plane represented by the line II—II in FIG. 1 showing the middle phase unit circuit breaker which exemplifies all units of the installation.
Figures 4, 5:
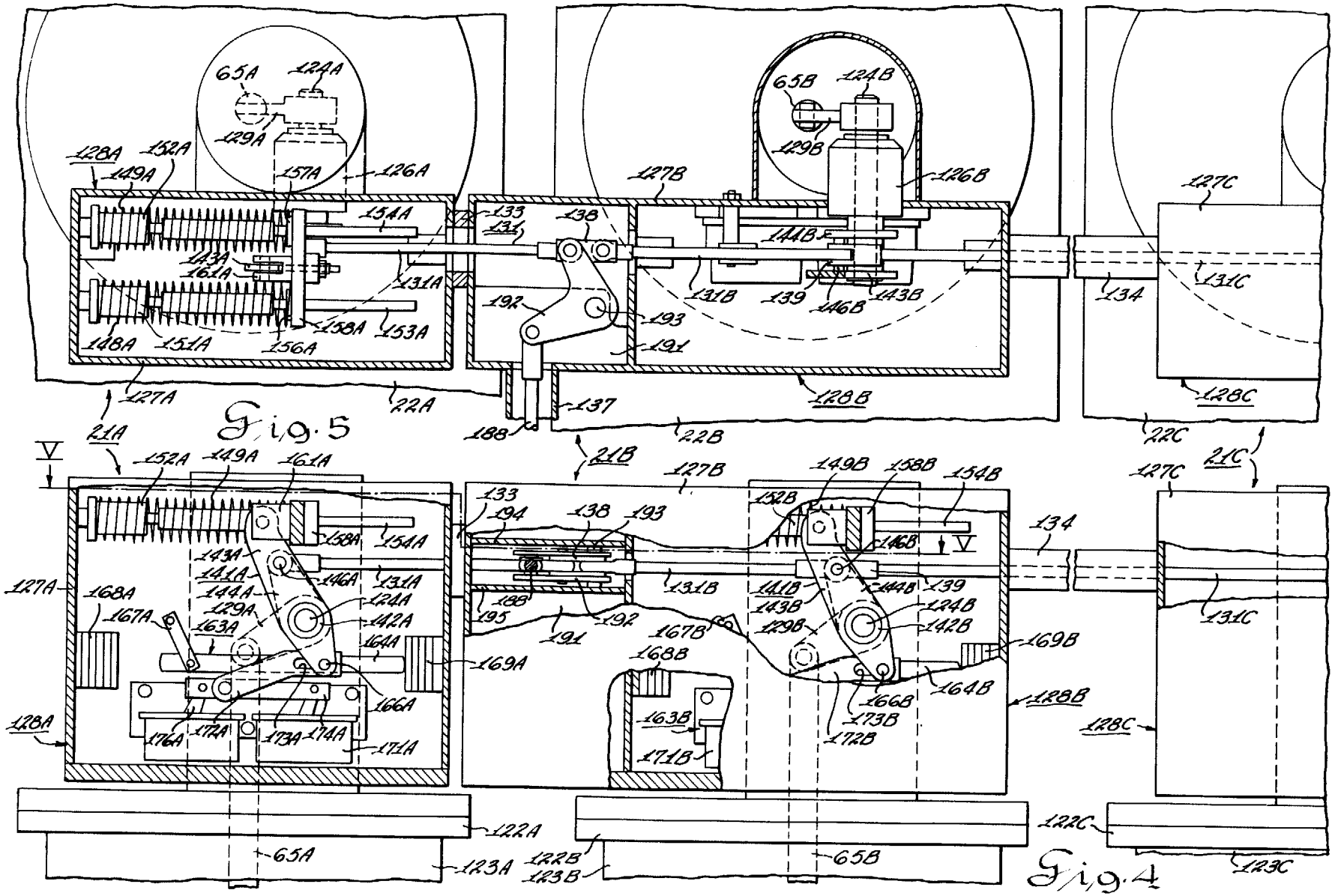
FIG. 4 is an enlarged fragmentary view partly in elevation and partly in vertical section through the contact operator taken generally in a plane represented by the line IV—IV in FIG. 2.
FIG. 5 is a view partly in plan and partly in horizontal section taken generally along line V—V of FIG. 4.

The actuating rod 65B extends upwardly through an insulator pipe 121B which is secured to a sealing closure plate 122B, FIG. 2, carried by a circular housing 123B that extends upwardly from the top of the tank 22B. As viewed in FIG. 3, upward movement of the actuating rod 65B will effect the opening movement of the movable contacts of both interrupters 28B and 29B and will also effect an opening of the associated blast valves. This movement is imparted to the actuating rod 65B by rotation of a gas sealed operating shaft 124B that is journalled in a bearing support 126B. The bearing support 126B extends through a wall of an external pull-rod mechanism 128B which is supported on top of the sealing enclosure plate 122B. Shafts 124A, 124B and 124C are exemplified by the arrangement of the shaft 124B as depicted in FIGS. 4 and 5. The extending end of the shaft 124B receives a lever 129B, the free end of which is pivotally connected to the upper end of the actuating rod 65B. Thus, rotation of the shaft 124B will effect the pivotal movement of the lever 129B in an upward direction and thereby the upward movement of the actuating rod 65B to effect the opening movement of the associated contacts and also the opening movement of the blast valves 38B. The opposite end of the shaft 124B extends outwardly from inside the tank into the external pull-rod mechanism housing 127B. A similar arrangement is provided for each of the other two circuit breakers 21A and 21C.

For effecting the simultaneous actuation of the actuating rods 65A, 65B and 65C associated with each of the circuit breakers 21A, 21B and 21C there is provided a single pull-rod system 130 which is operatively connected to effect the simultaneous actuation of each of the circuit breaker actuating rods 65A, 65B and 65C. With the pull-rod system depicted the movable contacts associated with each of the circuit breaker units 21A, 21B and 21C will be actuated in an opening or closing movement substantially simultaneously and the associated blast valve mechanism will likewise be actuated substantially simultaneously.

As shown in FIG. 1, 2, 4 and 5, the pull-rod system 130 includes a horizontal operating rod member 131 which extends through each of the external pull-rod unit mechanisms 128A, 128B and 128C and has an internal connection with each of the actuating rods 65A, 65B and 65C, respectively. The external pull-rod mechanisms 128A, 128B and 128C associated with the unit circuit breakers 21A, 21B and 21C, respectively, are shown in detail in FIGS. 4 and 5. As shown in FIGS. 4 and 5, the external pull-rod mechanisms 128A, 128B and 128C are interconnected by means of tubular spacers 133 and 134 with the external pull-rod mechanism 128B being connected to a vertical pull-rod end box 136 by means of a tubular housing 137. The pull-rod system includes the horizontally extending operating rod member 131 which is depicted as comprising three sections 131A, 131B and 131C that are connected together for simultaneous axial movement by couplings 138 and 139. An operable connection between each of the rotatable actuating shafts 124A, 124B and 124C within each external pull-rod unit mechanism and the axially movable operating rod 131 is established by means of associated operating cranks 141A and 141B and a similar crank (not shown) associated with the unit 128C.

The components within each pull-rod operating unit mechanism are identical. Thus, a description of the components associated with the mechanism 128B will apply to the components associated with the mechanisms 128A and 128C. The crank 141B includes a hub portion 142B which is engaged or drivingly secured to the extending end of the rotatable shaft 124B. Integrally formed with the hub 142B are a pair of spaced apart arms 143B and 144B; the arm 144B being somewhat shorter than the arm 143B. The arms 143B and 144B are disposed on each side of the rod 131 at the position of the coupling 139 and are pivotally connected thereto by means of a pin 146B. Thus, axial movement of the rod 131 in a rightwardly direction, as viewed in FIGS. 4 and 5, will cause the crank 141B to rotate in a clockwise direction which, in turn, effects rotation of the shaft 124B in a clockwise direction, FIG. 4. Clockwise rotation of the shaft 124B effects upward movement of the rod 65B and thereby effects an opening movement of the movable contact 32B and also the opening of the blast valve 38B.

The opening movement of the rod 131 in a rightwardly direction as viewed in FIGS. 4 and 5 is accelerated by means of energy stored in a pair of compression springs 148B and 149B. In FIG. 4, only one of the acceleration springs 149B is shown; while in FIG. 5, the acceleration springs have been omitted so that the other components can more clearly be seen. However, in FIGS. 4 and 5, the acceleration springs 148A and 149A associated with the pull-rod operating mechanism 128A are illustrated, and the description of this arrangement will also apply to the arrangement associated with the mechanisms 128B and 128C. Each of the compression springs 148A and 149A is mounted on a spool 151A and 152A that is supported from the side of the external pull-rod unit housing 127A. The right-hand ends of the springs 148A and 149A, as viewed in FIG. 5, are engaged on axially extending bosses 156A and 157A formed on a bridge member 158A that is engaged on both of the rods 153A and 154A. The bridge member 158A is provided with a centrally disposed leftwardly extending lug 161A to which the upper free end of the longer lever arm 143A of the crank 141A is pivotally connected. Thus, as the rod 131 is moved axially leftwardly, as viewed in FIGS. 4 and 5, to the contact closed position that it occupies, as shown, the arm 143A will pivot in a counterclockwise direction thereby moving the bridge member 158A on the parallel spaced rods 153A and 154A leftwardly to effect the compression of the springs 148A and 149A so that the stored energy therein will be available for a subsequent contact opening operation.

Since the rightward axial movement of the rod 131 in a contact opening movement is accomplised through the stored energy in the springs 148 and 149 associated with each of the pull-rod mechanisms 128A, 128B and 128C, the termination of the axial rightward movement of the rod 131 must be cushioned against a sudden stop to avoid shock loading to the arrangement shown. To this end, a shock absorbing arrangement 163 is provided for each of the pull-rod mechanisms 128A, 128B and 128C which is operable in both directions of the rod 131 to cushion the termination of the axial travel of the rod and which also operates to establish the limit of axial travel permitted to the rod. To this end, the lower ends of the arms 143A and 144A of the crank 141A are pivotally connected to a stop bar 164A by means of a pin 166A. The bar 164A is supported at its left end by a pivotal control arm 167A that is supported from the side wall of the housing 127A. At each end the bar 164A is disposed to engage a resilient shock absorber stop pad 168A and 169A depending upon the direction of movement of the bar 164A. The pads 168A and 169A comprise a plurality of individual sections and are secured to the end walls of the housing 127A. The pads 168A and 169A are only an auxiliary shock absorber means and by themselves are not sufficient to relieve the entire shock load that can be delivered by the opening or closing movement of the rod 131. Also, by adding or removing individual sections of the pads 168A and 169A, the limit of axial travel permitted to the rod 131 can be established. A main hydraulic shock absorber system 171A is provided and is connected to the rod 164A by means of a dog-legged link 172A having a portion thereof parallel to the bar 164A. In order that the rod 164A have relatively free travel for substantially all of its axial movement, the dog-legged link 172A or that portion of the link which is parallel to the rod is provided with a slot 173A which allows the arms of the crank 141A to pivot in an arcuate path of travel which is substantially equal to the full length of the axial travel of the rod 131A. Thus, as the springs 148A and 149A operate to effect axial rightward movement of the rod 131, the arms 143A and 144A will effect the rotational movement of the shaft 124A and the lower ends of the arms 143A and 144A within the slot 173A until such time as the axial rightward movement of the rod 131 has been substantially completed. At this time, the pin 166A will engage against the leftward end of the slot 173A thereby forcing the dog-legged link 172A to move leftward. With the dog-legged link 172A forced to move leftwardly, an interconnecting rod 174A, which is connected to the lower end of the link 172A and which is also connected to the actuating arm 176A of the hydraulic shock absorbing unit 171A, is also moved leftward thereby effecting the movement of a piston (not shown) which travels within the casing of the hydraulic unit and which is dampened by means of fluid contained within the casing. Thus, the hydraulic shock absorbers 171 associated with each of the operating mechanisms 128A, 128B and 128C are operative to absorb substantially all of the shock which accompanies the opening righward or closing leftward movement of the rod 131 when it is operated for effecting the opening movement of the circuit breaker contacts.

The horizontal rod 131 is normally maintained in switch closed position by operating mechanism 180, shown in FIGS. 6 and 7, which is disposed within a control cabinet 181 that is located at the left end of the installation, as shown in FIG. 2. The operating mechanism 180 is connected to the horizontal actuating rod 131 by means of a vertical movable rod 182 contained within a casing 183 that extends between the control cabinet 181 and the end box 136. Within the end box 136 the vertical rod 182 has a pivotal connection with a crank 186 which is supported for pivotal movement in a vertical plane by a pin 187 that is carried by the side wall of the box 136. At its opposite corner the crank 186 is pivotally connected to a horizontal rod 188 which extends transversely between the end box 136 and the operating rod 131 within the tubular casing 137. The end of the rod 188 extends within an operating compartment 191 associated with the pull-rod mechanism 128B, as shown in FIGS. 4 and 5. Within the operating compartment 191 the rod 188 has a pivotal connection with one end of a crank 192. The crank 192 is supported for pivotal movement in a horizontal plane by a pin 193 that is carried in a pair of spaced apart internal plates 194 and 195 that are welded to the wall of the compartment 191. The other end of the crank 192 has a pivotal connection with the rod 131 at the coupling 138. Thus, the single pull-rod system comprising the horizontal operating rod 131, transverse rod 188, the vertical rod 182 along with the operating mechanism 180, is operable to control the operation of the plurality of interrupters and blast valves of each of the circuit breakers simultaneously.

At its lower end of the vertical rod 182 is pivotally connected to the operating mechanism 180. As shown in FIGS. 6 and 7, the operating mechanism 180 comprises a single center support frame 201 on which is mounted a linkage arrangement 202 for operating the interrupter contacts. The supporting frame 201 comprises a back plate 203 and a bottom plate 204 to which the supporting frame 201 is secured with the mechanism being supported within the control cabinet 181 by suitable fasteners such as bolts that extend through the back plate 203 into the rear wall of the cabinet 181. The trip linkage 202 is mounted on the single center supporting frame 201 so that its components are symmetrically arranged on either side thereof. For simplicity of understanding, only those components on one side of the single center supporting frame 201 are hereinafter described but it is to be understood that the components on the other or opposite side, where necessary, are similar. On one side of the frame 201 the linkage mechanism 202 comprises a lever 206 pivotable about a pin 207 and also includes a lever 208 pivotal about a pin 209. Lever 206 is connected to the vertical operating rod 182 by a pivotal connection as at 211. The two levers 206 and 208 are interconnected by a toggle comprising two toggle links 212 and 213. The one toggle link 213 is pivotally connected to lever 208 by a pin 216 which also carries a roller 217. The toggle links are pivotally connected together by a pin 218 that also carries a roller 219 and which is acted upon by an operating ram 220 that extends through a suitable opening provided in the bottom plate 204.

In FIG. 6, the linkage 202 is illustrated in the contact closed position. In this position, the upper position of the roller 219 is limited by a shock absorbing abutment 221. In the position shown, the roller 219 is supported by a prop latch 222 which is biased into position by a spring 223. A spring 226 is operably connected at one end to a lug 227 on the bottom plate 204 and at its opposite end to the pin 218. Thus, upon the collapse of the toggle linkage the stored energy in the spring 226 operates to reset the toggle arrangement and thus a full trip operation of the operating mechanism 180.

When the operating mechanism 180 is tripped for effecting the opening of the circuit breaker contacts and the associated blast valves, the stored energy in all of the accelerator springs 148, 149 associated with the pull-rod unit mechanisms 128A, 128B and 128C are released so that the actuating rod 131 is moved rightwardly, as viewed in FIGS. 4 and 5, thereby moving the individual operating rods 65A, 65B and 65C in synchronization to effect the simultaneous opening movement of the contacts of all circuit breakers. The tripping of the operating mechanism 180 is effected by operating of the latch mechanism 230 comprising a first lever 231 which operates as a blocking latch. A release latch 233 and a trip solenoid 234 which includes a plunger 236 that is adapted to act on the release latch 233 is operable to permit the pivotal movement of the first lever 231. As is well known, the plunger 236 of the solenoid 234 can be operated either electromechanically by energization of the solenoid or by manual means. The release latch 233 is journalled for rotation on an axis which is transverse to the center frame 201 and is in the form of a cylinder that is formed with a cutaway portion which leaves a D-shaped segment 237, FIG. 7, having a rounded surface which engages the end of the latch 231. A tension spring 238 for resetting the cylinder-shaped release latch 233 is connected between the frame and the latch. Another tension spring 239 for resetting the first lever or blocking latch 231 is connected between the latch and the frame 201.

As shown in FIGS. 6, 7 and 8, the release latch 233 has a second cutaway portion which provides a second D-shaped segment 241, the flat surface of which is adapted to be engaged by the solenoid plunger 236. The two D-shaped segments 237 and 241 of the release latch 233 are disposed approximately at right angles with respect to each other. On rotation of the release latch 233 in a counterclockwise direction, as viewed in FIGS. 6 and 8, blocking latch 231 is freed and pivots about the pin 232 in a counterclockwise direction upon the action of a force component transmitted to it by the roller 217. The counterclockwise pivotal movement of the blocking latch 231 is followed by the collapse of the toggle formed by the toggle elements 212 and 213 and also movement of lever 206 to cause a separation of all of the circuit breaker contacts and operation of the associated blast valves.

To close the circuit breaker contacts and to return the operating mechanism 180 to the closed position that it occupies, as depicted in FIG. 6, the ram 220 is actuated upwardly by means of an operator (not shown) so as to engage the ram with the roller 219. This action will cause the toggle elements 212, 213 to move upwardly during the closing stroke of the ram and will cause the lever 206 to rotate about its pivot point 207 in a clockwise direction. The rotary motion of the lever 206 causes the operating rod 182 to move downwardly thereby effecting leftward movement of the actuating rod 131 to recharge all of the accelerator springs 148–149 of each of the pull-rod mechanisms 128A, 128B and 128C and move the contacts of the circuit breakers 21A, 21B and 21C to closed positions.

When the toggle elements 212–213 are in their normally closed positions, FIG. 6, the prop latch 222 under the action of the biasing spring 223 will slide under the roller 219. The blocking latch 231 retains the roller 217 in position adjacent the stop 243. The toggle formed by the elements 212-213 is retained in contact closed position by the combined action of the blocking latch 231 with release latch 233 and prop latch 222.

With the operating mechanism 180 in contact closed position, as depicted in FIG. 6, the contacts of all the circuit breakers 21A, 21B and 21C are also closed. Upon momentary energization of the trip solenoid 234 the plunger 236 actuates the release latch 233 in a counterclockwise direction. After a slight movement of the latch 233, blocking latch 231 is released to rotate counterclockwise about the pin 232 under the action of a force component transmitted to it by the roller 217. The counterclockwise rotation of the latch 231 releases or unlocks the operating linkage and roller 217 moves upwardly under the breaker action causing the collapse of the toggle formed by the elements 212, 213 and the contacts of the circuit breakers are opened under the force of the accelerator springs 148–149. During the collapse of the elements 212, 213, roller 219 slides off the prop 222. On complete collapse of the toggle, roller 217 settles back on the support 243 and latch 231 rotates clockwise under the influence of the spring 239 to its original position where it holds roller 217 on the stop 243. The release latch 233 rotates back to its reset position by the action of the spring 238 to hold the latch 231 in its reset position.

The operating mechanism 180 described herein incorporates novel mechanism which renders the operating mechanism 180 trip free only to the extent that it is selectively trip free. Operating mechanisms of the type described are normally fully trip free, that is, the contacts of the circuit breaker may be opened by the tripping means at any stage of the operating procedure described. However, while uncontrolled trip-free operation is highly desirable, as a matter of fact, it cannot be tolerated with circuit breakers of the type described herein. This type of circuit breaker requires that any time the contacts are parted, a blast of gas is required to be delivered to the arcing area. To insure that the blast valves of all the circuit breakers have reset to their closed position prior to contact separation and that the operating linkage 80 has been recoupled to the operating mechanism, the operaring mechanism 180 is prevented from being trip free until such time as the blast valve mechanisms 38 have returned to closed positions and also that the operating linkage 80 has been recoupled to the operating drive. To this end, there has been provided a novel selective operating mechanism 245 which prevents the operation of the toggle linkage 202 in a contact opening movement during the upward or closing stroke of ram 220. However, with this novel device the breaker is free to open at its normal opening velocity immediately upon completion of the closing stroke, and regardless of the position thereafter of the ram 220.

As shown in FIGS. 6 and 8, the selective operating mechanism 245 includes a push-rod 246 which is supported at its left end for guided horizontal movement into and out of engagement with a stop arm 247. The stop arm 247 is carried in depending relationship by the release latch 233. Thus, when the push-rod 246 is moved leftwardly from the position it occupies as shown in FIG. 8, it will engage the stop arm 247 thereby preventing counterclockwise releasing rotation of the release latch 233 by plunger 236. With the circuit breaker contacts in closed position, the push-rod 246 is normally disposed in the rightward position, as depicted in FIG. 8. When the circuit breakers 21A, 21B and 21C have been operated to a contact open position whereby the associated blast valves 38 are displaced to an open position to provide a blast of gas at a relatively high pressure to the arcing areas 42 and as a closing action is initiated by the ram 220, the push-rod 246 will be moved leftwardly to engage the stop lever 247 to effectively prevent another movement of the release latch 233 until such time as the blast valves 38 have returned to closed position and that their operating linkage has been recoupled to the operating mechanism at the end of the ram stroke. This assures that the circuit breaker cannot be tripped again until such time as the blast valves 38 and their actuating means are reconditioned for supplying the blasts of gas to the arcing areas 42.

For effecting the axial leftward movement of the push-rod 246 there is provided a control cam 251 that is adapted to be moved with the lever 206. To this end the control cam 251 is mounted on the pin 207 for pivotal movement relative to the pin. The movement of the control cam 251 is synchronized with the movement of the lever 206 and for this purpose is fastened to the lever 206 by bolt 252. In FIG. 6, the operating mechanism 180 and the selective operating mechanism 245 are shown in the position that they are disposed in when the circuit breaker 21 is in contact closed position. In this position the lever 206 is in its full clockwise angular position. As a result, the control cam 251 is also in its full clockwise angular position. Thus, an arcuate cam surface 253 of the control cam 251 is disposed so that the upper or left-hand edge 254 thereof is just clear of an edge 257 of a pawl 258. The pawl 258 is carried for limited angular movement on the pin 259 which is mounted in a depending arm 261 that is threadedly engaged in the hub 262 of a crank 263. Limited angular movement of the pawl 258 is controlled by another pin 266 which is also carried by the arm 261 and which is engaged in an oversized opening 267 formed in the pawl 258. A spring 268 operating between the crank body and an extending lug of the pawl 258 operates to urge the pawl in a counterclockwise direction.

Axial movement is imparted to the push-rod 246 by the crank 263. To this end the crank 263 is mounted for pivotal movement on a pin 271 which is carried on a bracket 272 attached to the back plate 203. The upper end of the crank 263 is pivotally connected to a clevis 273 by means of a pivot 274. A tension spring 276 has one end connected to the pin 274 and its opposite end connected to a pin 277 that is carried by the bracket 272. Thus, the spring 276 operates to urge the crank 263 in a clockwise direction.

The right end of the push-rod 246 is threadedly engaged in a coupling 281. The opposite or right-hand end of the coupling 281 receives the end of the connecting rod 282 which is secured to the coupling by the transverse pin 283. The right-hand end of the connecting rod 282 is slidably disposed in a clevis 273 and is prevented from being withdrawn from the clevis by the shouldered head 284 of rod 282. Mounted about the connecting rod 282 and operating between the facing axial ends of the coupling 283 and the clevis 273 is a compression spring 286. When the push-rod 246 is moved axially leftwardly, as viewed in FIGS. 6, 7 and 8, the end thereof will forcefully engage against the stop 247. Thus, the spring 286 operates to provide the necessary resiliency required so that the push-rod 246 is firmly but yieldably held in engagement with the stop arm 247. This arrangement provides the necessary safety factor required in a mechanical structure such as disclosed herein.

In operation, with the operating mechanism 180 in circuit breaker position, as depicted in FIG. 6, a signal due to a condition, such as a fault condition in a circuit which the breaker 21 is protecting, will energize the solenoid 234. The plunger 236 will effect the small angular displacement of the release latch 233 necessary to effect the release of the latch 231. With the latch 231 released, the toggle collapses and the stored energy in the accelerator springs 148–149 associated with each of the external pull-rod mechanisms 128A, 128B and 128C operates to move the rod 131 rightwardly thereby causing the operating rods 65A, 65B and 65C to be moved axially upwardly. This upward movement of the rods 65A, 65B and 65C will effect contact opening movement and also the opening of the blast valves, as previously described herein.

At the time that the toggle arrangement of mechanism 180 collapses, the lever 206 will pivot in a counterclockwise direction, as viewed in FIG. 6, and simultaneously therewith, of course, will effect the pivotal movement of the control cam 251 in a counterclockwise direction. As the control cam 251 moves in a counterclockwise direction, the cam surface 253 will move under the edge 257 of the pawl 258 tipping the pawl in a clockwise direction so as to allow the free passage of the control cam into the position it occupies as depicted in FIG. 8. As the control cam 251 moves under the pawl 258 in a counterclockwise direction, no movement is imparted to the push-rod 246 as the pawl 258 pivots in a clockwise direction just sufficiently far enough to allow the cam to pass underneath it. At the time the control cam 251 is moving in the counterclockwise direction, the contacts of the circuit breakers are being moved to an open position.

When the control cam 251 is in the position shown in FIG. 8, the contacts of the circuit breakers are in open position. Assuming that a signal has been obtained to effect a reclosing of the contact, such signal will operate to energize the source of power (not shown) associated with the ram 220 to move the ram 220 in a closing stroke. At this particular point in time, it becomes necessary to insure that once the contacts are closed they cannot again be reopened until the blast valves associated with the individual contacts are closed and the valve operating latch body 94 is recoupled to the cam member 81. Thus, when the ram 220 is energized and moves upwardly, as viewed in FIG. 6, it will engage the roller 219 to effect a resetting of the toggle linkage to the condition shown in FIG. 6. In this movement, the lever 206 will be caused to move in a clockwise direction thereby moving the control cam 251 also in a clockwise direction. Thus, as viewed in FIG. 8, when the control cam 251 is moved in a clockwise direction the surface 253 will move under the pawl 258 and by virtue of the fact that the pin 266 is in engagement with the left side of the oversized hole 267, the force exerted on the pawl 258 will be transmitted to the arm 261 forcing the crank 263 to pivot in a counterclockwise direction about the pin 271. This action moves the push-rod 246 leftwardly thereby engaging it against the stop arm 247 to prevent angular displacement of the release latch 233 regardless of the fact that a signal may occur to energize the solenoid to effect its operation. As the control cam 251 is moving in the clockwise direction from the position it occupies in FIG. 8 to the position depicted in FIG. 6, the latch body 94B, FIG. 2, will have been returned to the vertical position depicted in FIG. 3 and the cam member 81B will have been returned to the position that it occupies in FIG. 3, thereby recoupling the latch body 94B to the cam member 81B for a subsequent contact opening movement.

Thus, the selective operating mechanism 245 operates to insure that the circuit breaker contacts 31–32 cannot be opened until such time as the blast valves 38 associated with the contacts are in closed position and are recoupled to the operating mechanism so that the opening movement of contacts will also include the opening movement of the blast valves to thereby insure that a blast of gas will be provided to the arcing area. This safety factor insures that at any time the contacts are moved to an open position that the arc drawn between the movable contact 32B and the stationary contact 31B will be extinguished by a blast of gas, thus preventing burnout or other damage to the equipment.

From the foregoing, it is apparent that this invention provides a means for effecting the opening and closing movement of a plurality of interrupters associated with individual circuit breakers of a three-phase installation which requires but a single pull-rod system for effecting such operation. It is also apparent that a novel selective mechanism has been provided which insures that the blast valves are in closed position prior to the opening of the contacts so as to effectively prevent damage and burnout to the equipment.

The embodiments of the invention in which an exclusive property or privilege is claimed are defined as follows:

1.

In a mechanism for mechanically actuating the separable contacts and associated blast valves of one or more gas insulated circuit breakers each having a gas insulated sealed enclosure in which the contacts and blast valves are operatively disposed, said circuit breaker including mechanical operating means within the sealed enclosure for mechanically operating the associated contacts and blast valves;

an external pull-rod mechanism supported externally of each of the enclosures of each circuit breaker;

drive means operably connected to be actuated by said pull-rod mechanism and extending from said external pull-rod mechanism into an associated circuit breaker enclosure in gas sealed relationship;

mechanical connecting means operably connected between the end of said drive means within a sealed enclosure and the associated circuit breaker contact and blast valve mechanical operating means for establishing a continuous operable mechanical connection between the external pull-rod mechanism and the internal circuit breaker contact amd blast valve mechanical operating means; and control means remote from said external pull-rod operating mechanism and operably connected to control the operation of each of said external pull-rod operating mechanisms in a contact and blast valve opening and closing movement.

2. In a mechanism for mechanically actuating the separable contacts and associated blast valves of one or more gas insulated circuit breakers each having a gas insulated sealed enclosure in which the contacts and blast valves are operatively disposed, said circuit breaker including mechanical operating means within the sealed enclosure for mechanically operating the associated contacts and blast valves;

an external pull-rod mechanism supported externally of each of the enclosures of each circuit breaker, said external pull-rod mechanism including mechanical means for imparting a force;

mechanical drive means including a rotatable shaft extending from said external pull-rod mechanisms into an associated circuit breaker enclosure in gas sealed relationship and operably connected to receive and transmit the force of said external pull-rod mechanism mechanical means;

springs operably connected to effect movement of an associated drive means for effecting a contact and blast valve opening operation;

lever means operably connected to said springs and to said rotatable shaft for transmitting the force of said springs to said rotatable shaft for effecting an opening operation of said contacts and said associated blast valves; and, mechanical control means remote from said external pull-rod mechanisms and operably connected to control the operation of each of said external pull-rod mechanisms for simultaneous operation.

3. A mechanism according to claim 2 wherein said control means remote from said external pull-rod mechanisms is connected to said external pull-rod mechanism by mechanical means including a first rod extending from said control means to an end box; and, a second rod operatively connected within said end box to be moved by said first rod and disposed in a plane transverse to the plane in which said first rod is disposed, said second rod being also connected to said operating rod;

whereby the control means is operable through said first and second rods to maintain said actuating rod in its circuit breaker contact closed position.

4. A mechanism according to claim 3 wherein said control means is disposed within a control cabinet located at the enclosure end of said circuit breakers;

a first housing extending from said control cabinet and encasing said first rod;

an end box carried on the end of said first housing remote from said control cabinet;

a second housing extending from said end box into an external pull-rod mechanism, said second housing encasing said second rod;

a crank operably supported within said end box and operably connected to the ends of said first and second rods therein in a manner that movement of said first rod in one direction is transmitted to said second rod for movement in another direction; and, a motion transfer crank operably supported within the external pull-rod mechanism in which the end of said second rod extends, said motion transfer crank being operably connected to said rod and to said actuating rod.

5. A pull-rod system according to claim 4 wherein said connecting means operatively interconnecting said operating mechanism and said actuating rod includes a first connecting rod disposed for movement in a plane which is transverse to the plane in which said actuating rod moves;

a second connecting rod disposed for movement in a plane which is transverse to the planes in which said actuating rod and said first connecting rod are movable;

a lever operatively connecting said operating mechanism to said first connecting rod to impart movement thereto;

a first crank operatively interconnecting said first connecting rod to said second connecting rod; and, a second crank operatively connecting said second connecting rod to said actuating rod;

whereby said operating mechanism can impose a restraint on said actuating rod through said connecting rods to prevent the movement of said actuating rod in a contact opening movement.

6. A pull-rod system according to claim 5 wherein said first crank is operatively connected to pivot about an axis that is transverse to the direction in which first connecting rod is movable and also is transverse to the direction in which said second connecting rod is movable;

said second crank is operatively connected to pivot about an axis that is parallel to the direction in which said first connecting rod is movable and also is transverse to the direction in which said actuating rod is movable; and, wherein there is provided a third crank operably connected to pivot about an axis which is transverse to the directions along which said actuating rod and said first connecting rod are movable and is parallel to the direction in which said second connecting rod moves.

7. In a pull-rod system for controlling the movement of the separable contacts and associated blast valves of the individual phase units of a three-phase gas insulated circuit breaker installation;

an external pull-rod mechanism operatively associated with each phase unit, each of said external pull-rod mechanisms having drive means operatively connected to actuate the contacts and blast valves within each phase unit to open and closed positions;

an operating mechanism located externally of said circuit breaker installation at one end thereof;

an actuating rod extending across the top of said circuit breaker installation and through each phase unit external pull-rod mechanism, said actuating rod being operably connected to effect the simultaneous movement of the contacts and blast valves of the individual phase units of said circuit breaker installation;

lever means operatively connected to said actuating rod and to said drive means of said individual external pull-rod mechanisms in a manner that movement of said actuating rod in one direction will effect an opening movement of the contacts and blast valves of all of said phase units simultaneously; and, connecting means operatively interconnecting said operating mechanism and said actuating rod and operable in response to the operation of said operating mechanism to restrain said actuating rod to thereby maintain said circuit breaker contacts in circuit closed position, said connecting means being responsive to the release operation of said operating mechanism to release the restraint imposed on said actuating rod to thereby permit the operation of said actuating rod in a circuit breaker contact and blast valve opening movement.

8. A pull-rod system according to claim 7 wherein the drive means of each phase unit is a shaft extending into each phase unit in sealed relationship; and, there is provided forcing means in each external pull-rod operating mechanism, said forcing means being operatively connected to said lever means in a manner that the forcing means acts on said lever means to apply an output thereto in one direction which is transmitted to said actuating rod for effecting its movement in a contact and blast valve opening operation;

whereby the combined output of the forcing means of each external pull-rod mechanism acts on said actuating rod to thereby effect the simultaneous opening movement of all phase unit contacts and blast valves.

9. In a gas insulated circuit breaker having a pair of relatively movable arcing contacts normally urged to open position and an associated displaceable blast valve normally biased to a closed position and operable when displaced to direct a blast of gas to said arcing contacts;

a control means operably connected to maintain said relatively movable arcing contacts in closed position, said control means being operable when tripped to release said contacts so that the relatively movable arcing contacts move to the open position;

means releasably coupling said blast valve to said relatively movable arcing contacts in a manner that the movement of said contacts to open position operates to displace said blast valve to open position;

means operable in response to the opening of said contacts to decouple said releasable coupling means to permit said blast valve to return to its normally closed position;

means responsive to a signal to trip said control means; and, means responsive to the tripped condition of said control means to render said signal responsive means ineffective until such time as said blast valve releasable coupling means is recoupled to said relatively movable arcing contacts.

10. In a gas insulated circuit breaker having a pair of relatively movable arcing contacts and an associated displaceable blast valve for directing a blast of gas to the separable contacts;

first operating means connected to actuate said arcing contacts to open and closed circuit positions;

second operating means connected to displace said blast valve from its normally closed position, said second operating means being releasably coupled to said first operating means, said releasable coupling means being operative upon the opening of said blast valve to release said second operating means from said first operating means;

means to return said second operating means to its initial position for recoupling to said first operating means when said first operating means has been operated to move said relatively movable arcing contacts to closed position;

a latch mechanism operably connected to prevent said first and second operating means from operating, said latch mechanism being operable when tripped to release said first and second operating means so that said first operating means operates to open said relatively movable arcing contacts and said second operating means operates to displace said blast valve;

a signal responsive actuator operable in response to a signal to trip said latch mechanism; and, means operable when actuated to render said signal responsive actuator ineffective for tripping said latch mechanism until such time as said first operating means has operated to move said relatively movable arcing contact to closed circuit position and has recoupled with said second operating means.

11. In a mechanism for actuating the relatively movable arcing contacts and associated blast valves of one or more gas insulated circuit breakers each having a gas insulated sealed enclosure in which the contacts and blast valves are operatively disposed, said circuit breaker including operating means within the sealed enclosure for operating the associated contacts and blast valves;

an external pull-rod mechanism supported externally of each of the enclosures of each circuit breaker, said external pull-rod mechanism including mechanical means for imparting a force;

drive means extending from said external pull-rod mechanisms into an associated circuit breaker enclosure in gas sealed relationship and operable to receive and transmit the force of said external pull-rod mechanism mechanical means;

a control device operably connected to maintain said external pull-rod mechanisms in a retracted position to maintain said relatively movable arcing contacts in closed position, said control device being operable when tripped to release said external pull-rod mechanisms so that the relatively movable arcing contacts are moved to open position;

means releasably coupling said blast valve to said relatively movable arcing contacts in a manner that the movement of said contacts to open position operates to displace said blast valve to open position;

means operable in response to the opening of said contacts to decouple said releasable coupling means to permit said blast valve to be returned to its normally closed position;

means responsive to a signal to trip said control device; and, means responsive to the tripped condition of said control device to render said signal responsive device ineffective until such time as said blast valve releasable coupling means has been recoupled to said relatively movable arcing contacts.

12. In a mechanism for controlling the operating means of a contact and blast valve actuating mechanism of a gas insulated circuit breaker;

a frame;

control means supported by said frame for movement between a first position and a second position;

first means carried by said frame and operably connected to effect the angular movement of said control means from its first position to its second position;

second means carried by said frame and operably connected to effect the angular movement of said control means from its second position to its first position;

actuating means for effecting the operation of said second means for moving said control means from its second angular position to its first angular position; and, immobilizing means carried by said frame and operably connected to be actuated by said control means when said control means is moved angularly from its second position to its first position, said immobilizing means operating when actuated to render said first means ineffective for operation until said control means is returned to its first angular position.

13. In a mechanism for controlling the operating means of the contact and blast valve actuating mechanism of a gas insulated breaker;

a frame;

control means supported by said frame for angular movement to a first position and a second position;

operating means operably connected to effect the angular movement of said control means to said first and second positions;

first means carried by said frame and operable to effect the actuation of said operating means for moving said control means angularly from its first position to its second position;

second means carried by said frame and operably connected to actuate said operating means for moving said control means from its second position to its first position; and, immobilizing means carried by said frame and operably connected to be actuated by said control means when said control means is moved angularly from its second position to its first position, said immobilizing means operating when actuated to render said first means ineffective for operation until said control means has been returned to its first angular position.

14. In a mechanism for controlling the operating means of the contact and blast valve actuating mechanism of a gas insulated circuit breaker;

a frame;

control means supported by said frame for angular movement between a first position and a second position;

drive means operably connected to effect the angular movement of said control means;

a first means carried by said frame and operable to effect the operation of said drive means for moving said control means from its first position to its second position;

a second means carried by said frame and operable to effect the operation of said drive means for moving said control means from its second position to its first position; and, immobilizing means carried by said frame and operably connected to be actuated by said control means when said control means is moved angularly from its second position to its first position, said immobilizing means operating when actuated to render said first means ineffective for operation until said control means has been returned to its first angular position.

15. A mechanism according to claim 14 wherein said immobilizing means includes a mechanical stop operatively arranged to be positively engaged with said first means to render said first means inoperative.

16. A mechanism according to claim 15 wherein said mechanical stop includes a push-rod operatively connected to be moved by said control means as said control means moves angularly from its second position to its first position.

17. A mechanism according to claim 16 wherein immobilizing means also includes a crank pivotally supported by said frame in position to actuate said push-rod, said crank being pivotally moved to actuate said push-rod into engagement with said first means by the angular movement of said control means as said control means moves from its second position to its first position.

18. A mechanism according to claim 17 wherein there is provided a pawl pivotally connected to the end of said crank adjacent said control means, said pawl being constructed and arranged to permit said control means to move from its first position to its second position without actuating said crank, and being operable to effect the pivotal movement of said crank in a push-rod actuating movement when engaged by said control means as said control means moves from its second position to its first position.

19. In a mechanism for controlling the operating means of the contact and blast valve actuating mechanism of a gas insulated circuit breaker;

a frame;

control means supported by said frame for angular movement between a first position and a second position;

drive means operably connected to effect the angular movement of said control means;

a first means carried by said frame and operable to effect the operation of said drive means for moving said control means from its first position to its second position;

a second means carried by said frame and operable to effect the operation of said drive means for moving said control means from its second position to its first position;

a mechanical stop operatively arranged to be positively engaged with said first means to render said first means inoperative;

a push-rod operatively connected to be moved by said control means as said control means moves angularly from its second position to its first position;

a crank pivotally supported by said frame in position to actuate said push-rod, said crank being pivotally moved to actuate said push-rod into engagement with said first means by the angular movement of said control means as said control means moves from its second position to its first position; and a pawl pivotally connected to the end of said crank adjacent said control means, said pawl being constructed and arranged to permit said control means to move from its first position to its second position without actuating said crank, and being operable to effect the pivotal movement of said crank in a push-rod actuating movement when engaged by said control means as said control means moves from its second position to its first position.

20. A mechanism according to claim 19 wherein said operating mechanism immediately upon the release of said restraining means will operate at full normal opening velocity independent of the position of said power actuator.

* * * * *

UNITED STATES PATENT OFFICE

CERTIFICATE OF CORRECTION

Patent No. 3,932,719 Dated February 11, 1976

Inventor(s) Edwin C. Goodwin and George K. Benham

It is certified that error appears in the above-identified patent and that said Letters Patent are hereby corrected as shown below:

Column 14, line numbered 55 "amd" should be ---and---;

line numbered 55 ---,--- was omitted after "and" (second occurrence);

Column 17, line numbered 27 ---normally--- was omitted after "the";

Column 19, line numbered 12 ---circuit--- was omitted after "insulated";

Signed and Sealed this twentieth Day of April 1976

[SEAL]

Attest:

RUTH C. MASON
*Attesting Officer*

C. MARSHALL DANN
*Commissioner of Patents and Trademarks*